US006138457A

United States Patent [19]

Lackstrom et al.

[11] Patent Number: 6,138,457

[45] Date of Patent: Oct. 31, 2000

[54] COMBUSTION POWERED COOLING SYSTEM

[75] Inventors: David Lackstrom; Thomas B. de Treville, both of Cape Canaveral, Fla.

[73] Assignee: Applied Power Technology Incorporated, Cape Canaveral, Fla.

[21] Appl. No.: 09/258,385

[22] Filed: Feb. 26, 1999

[51] Int. Cl.[7] ..... F01K 25/08

[52] U.S. Cl. ..... 60/651; 60/671

[58] Field of Search ..... 60/645, 651, 670, 60/671; 62/238.1, 401, 402

[56] References Cited

U.S. PATENT DOCUMENTS 4,033,141 7/1977 Gustafsson ..... 60/651 X
4,706,705 11/1987 Yogev et al. ..... 60/651
4,876,856 10/1989 Iishiki et al. ..... 60/651 X

*Primary Examiner*—Hoang Nguyen
*Attorney, Agent, or Firm*—Christopher L. Parmelee; Ralph E. Jocke; David R. Percio

[57] ABSTRACT

A combustion powered cooling system (10, 100) includes a power loop (12, 102) and a cooling loop (14, 104). Heat produced by combustion is used to produce superheated steam in a steam generator (18). The steam is used to move a reciprocating steam piston (26) in a power unit (16). Power is transferred from the steam piston through a energy transfer mechanism (44) to a compressor piston (40) in the cooling loop. Refrigerant material in the cooling loop is used to provide air conditioning for a residence or other facility through a chilled water circuit (60). The system is also operative as a heat pump for heating a residence or other facility.

33 Claims, 13 Drawing Sheets

Ph.Tb
Pa.Ta
P1. T1
P2. T2
Le1
Le2

The valves are actuated by compression processes.
The valves control the present processes of steam expander.

LAYOUT OF VAPOR EXPANSION ENGINE.

| | |
|---|---|
| BOILER TYPE | FLASH SUPERHEATING BOILER |
| DESIGN PRESSURE MAXIMUM | 1500 psig |
| OPERATING | 1000 psig |
| DESIGN TEMPERATURE MAXIMUM | 1300 F |
| OPERATING | 1000 F |
| FEEDWATER TEMPERATURE | 100F |
| TARGET EFFICIENCY (HHV) | 83% |
| FLOW RATE | 0.25 lb/hr (could be higher) |
| BURNER | NATURAL GAS LPG. FORCED DRAFT |

COMBUSTION POWERED COOLING SYSTEM

TECHNICAL FIELD

This invention relates to heat transfer systems. Specifically this invention relates to a combustion powered cooling system, such as an air conditioning system powered by natural gas.

BACKGROUND ART

Numerous types of heat transfer systems have been developed. Prior systems include vapor compression type heat pump systems which may be used for heating and/or cooling an interior area of a structure or water housed in a pool or other reservoir. Such prior systems have most often been powered electrically. Other systems have been powered by combustion processes such as the systems shown in U.S. Pat. Nos. 5,509,274; 5,313,874; 5,246,350; and 5,205,133.

In the development of combustion powered heat transfer systems advances are constantly sought. Increases in heat transfer capacity and energy efficiency are always desired. Other areas in which improvements in such systems are desirable include reliability, cost of equipment and cost of operation.

A limitation of some types of heat transfer systems that include heat pumps is that they are of limited effectiveness when outside temperatures are low. As a result persons desiring to heat a building with a heat pump system must also have an auxiliary heat source. Such alternative heat sources are conventionally either electric resistance heat or a gas fired heater. Due to the often relatively low cost of natural gas and the increases in efficiency that have been achieved in recent years with gas furnaces, many persons prefer to heat solely with natural gas where it is available. When air conditioning is desired, a separate vapor compression type system must be combined with the heating system to provide cooling during summer months. This results in an operator incurring higher costs for an electrically powered vapor compression air conditioning system and a gas fired heating system. The air conditioning system uses relatively more expensive electrical power which increases overall utility costs.

Thus there exists a need for a combustion powered cooling system that can operate using natural gas to cool a building, fluid or other item. There further exists a need for a combustion powered cooling system that has a higher capacity, is more energy efficient, is relatively low in cost and is more reliable than existing systems. There further exists a need for a combustion powered cooling system that may be readily modified and used as a heating device.

DISCLOSURE OF INVENTION

It is an object of the present invention to provide a combustion powered cooling system.

It is a further object of the present invention to provide a cooling system that is powered by natural gas.

It is a further object of the present invention to provide a combustion powered cooling system that has higher efficiency.

It is a further object of the present invention to provide a combustion powered cooling system that has greater reliability.

It is a further object of the present invention to provide a combustion powered cooling system that is economical to produce and operate.

It is a further object of the present invention to provide a combustion powered cooling system that uses very little electricity in its operation.

It is a further object of the present invention to provide a combustion powered cooling system that does not require an external source of electricity for its operation.

It is a further object of the present invention to provide a combustion powered cooling system that may be combined with a combustion powered heating system.

It is a further object of the present invention to provide a method of cooling which is powered by combustion.

Further objects of the present invention will be made apparent in the following Best Modes for Carrying Out Invention and the appended claims.

The foregoing objects are accomplished in a preferred embodiment of the invention by a combustion powered cooling system that includes a power loop and a cooling loop. The system further includes a power unit which operates to transfer energy from a first working fluid which flows in the power loop, to a second working fluid which flows in the cooling loop.

The power loop includes a gas fired steam generator that produces superheated steam. The superheated steam is selectively delivered to an expander end of the power unit. The expander end includes a steam piston which moves in a reciprocating motion as steam is expanded and exhausted. The spent steam which is exhausted from the expander end of the power unit is condensed to water in a condenser and passed through a condensate pump which returns the water to the steam generator. In one form of the invention the condensate pump is powered by the steam in the power loop.

The cooling loop includes a refrigerant material. The refrigerant material in the vapor phase is compressed in a compressor end of the power unit. The compressor end includes a reciprocating piston which moves in response to the power supplied to the steam piston in the expander end of the power unit. The compressor end of the power unit compresses the refrigerant material which flows to a condenser. As the refrigerant material is condensed to a liquid in the condenser, it loses heat to the atmosphere or other heat sink outside the air conditioned area, or away from the material that is cooled by the cooling system.

The condensed refrigerant material is passed through an expansion valve and expands in an evaporator. The refrigerant material gains heat in the evaporator which results in cooling the area or material to which the evaporator is connected. The heat absorbed by the refrigerant material in the evaporator causes the refrigerant material to return to the vapor phase. The vapor then returns to the compressor end of the power unit.

The power unit includes a power transfer mechanism for effectively transferring power from the expander end to the compressor end. The power unit further preferably includes a starter mechanism for starting the reciprocating action of the pistons in the power unit. The power unit may include a connection to an electric generator which provides electric power for operation of valves and other components in the system. In a preferred embodiment of the system non-rigid couplings are provided for the pistons at both ends of the power unit. This enables producing a closed power loop and cooling loop which serves to increase reliability of the system.

BEST MODES FOR CARRYING OUT INVENTION

Figure 1:
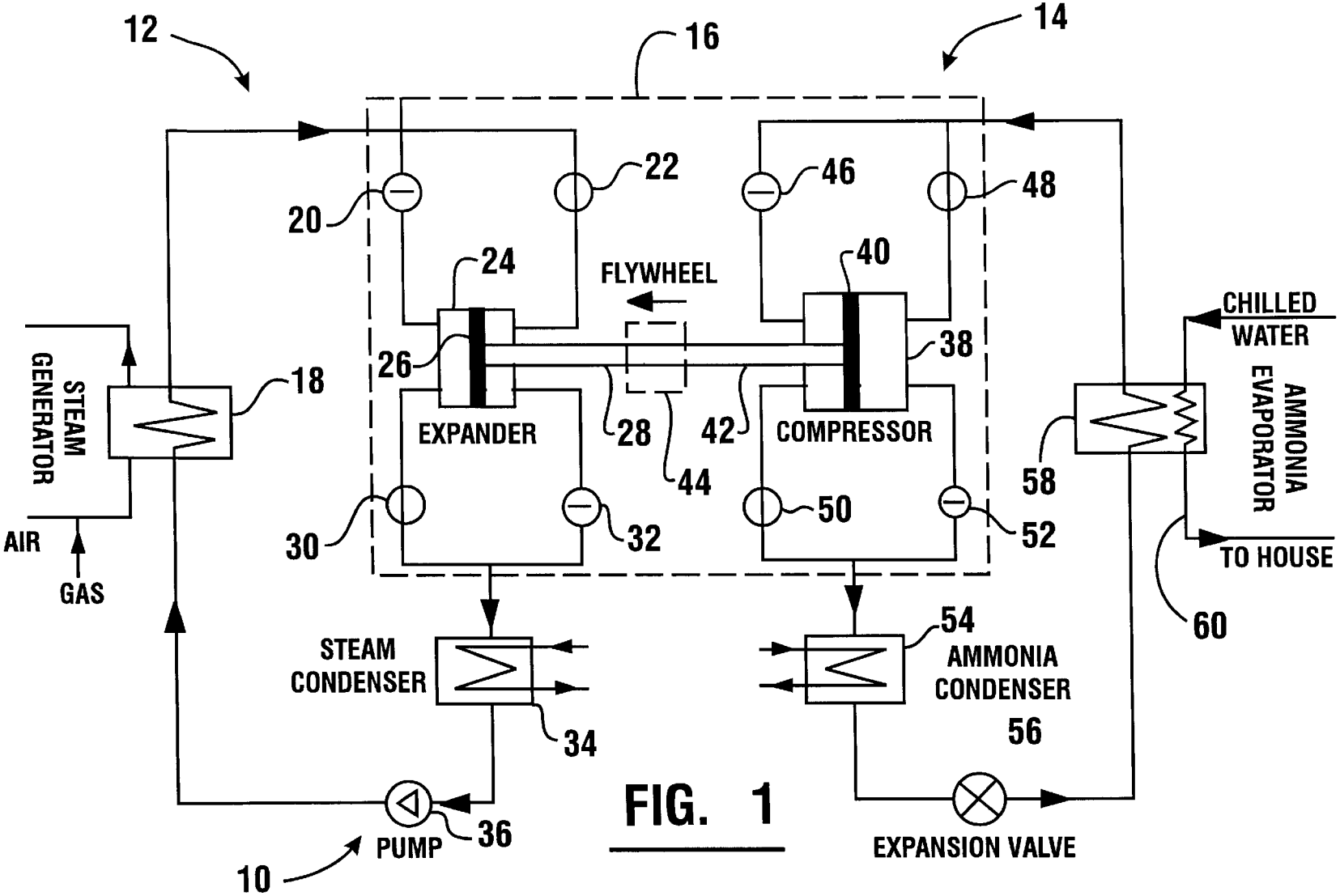
FIG. 1 is a schematic view of a first embodiment of the combustion powered cooling system of the present invention.

Referring now to the drawings and particularly to FIG. 1, there is shown therein a first embodiment of the combustion powered cooling system of the present invention generally indicated 10. System 10 includes a power loop 12 and a cooling loop 14. A power unit schematically indicated 16 operates to transfer energy from the power loop to the cooling loop.

The power loop has a first working fluid therein. In the preferred form of the invention the first working fluid is water. However, in alternate embodiments the first working fluid is an organic refrigerant and has good lubricating properties. The water in the power loop 12 is heated to produce superheated steam in a steam generator 18. As later described in detail the steam generator operates in the preferred embodiment to produce heat by combustion of a mixture of air and natural gas. The heat produced by combustion is transferred to the water in the power loop.

The superheated steam from the steam generator 18 is passed to the power unit 16. The power unit includes a first injection valve 20 and a second injection valve 22. The injection valves are preferably electronically controlled valves which operate to selectively enable the flow of superheated steam therethrough at about 600 degrees Fahrenheit and 300 psig. The injection valves preferably include movable metal diaphragms that enable the valves to operate in a range of about 720 to 1,000 cycles per minute.

The injection valves alternatively deliver steam in measured amounts for expansion efficiency into opposed sides of a steam cylinder schematically indicated 24. A steam piston 26 is movably mounted in the cylinder. The piston is operatively connected to a connecting rod 28 through magnetic coupling or a similar non-rigid connection as later discussed in detail.

The cylinder 24 is connected to a first exhaust valve 30 and a second exhaust valve 32. The exhaust valves operate to selectively enable expanded steam to alternatively exhaust from opposed ends of the cylinders. The exhaust valves may be electronically actuated valves, mechanical valves or other valve types.

After passing through the exhaust valves, expanded steam is condensed to water in a steam condenser 34. In the steam condenser the fluid in the power loop loses heat to a heat sink such as to atmosphere or other heat accepting environment. After leaving the condenser 34 the water which has now been condensed to the liquid phase, is pumped by a condensate pump 36 back to the steam generator 18. In the preferred form of the invention the condensate pump delivers the liquid water at a pressure of approximately 300 psig. The condensate pump 36 may in various embodiments be an electrically powered piston or other type pump. Alternatively the condensate pump may be of the type shown in the alternative form of the system shown in FIG. 9 and later discussed in detail.

The cooling loop 14 has a second working fluid therein. In the preferred form of the invention the second working fluid is a refrigerant material such as ammonia. In alternative embodiments other types of working fluids might be used.

The refrigerant material in the cooling loop is passed into a compression cylinder 38. Compression cylinder 38 has a piston 40 movably mounted therein. Piston 40 is operatively coupled to a connecting rod 42 through magnetic coupling or other similar non-rigid coupling as later discussed.

Energy is transferred from the steam piston 26 on the expander end of the power unit to the compressor piston 40 on the compressor end of the power unit, through an energy transfer mechanism 44. In the preferred form of the invention the energy transfer mechanism includes a rotating flywheel. However in other embodiments of the invention other types of energy transfer mechanisms may be used.

Refrigerant in the vapor phase enters the compression cylinder 38 through either a first inlet check valve 46 or a second inlet check valve 48. Valves 46 and 48 are connected to opposed sides of compression cylinder 38. The check valves 46 and 48 are arranged so as to enable flow of refrigerant material only in a direction into the compression cylinder.

Compression cylinder 38 is further connected to a first outlet check valve 50 and a second outlet check valve 52. The first and second outlet check valves are connected to opposed sides of the cylinder and are configured to only enable refrigerant material to pass out of the respective ends of the cylinder. In the preferred form of the invention check valves 46, 48, 50 and 52 are each metal disc type check valves of conventional types. In other embodiments other types of valves may be used.

As piston 40 reciprocates back and forth in compression cylinder 38, the inlet and outlet check valves alternatively open and close. The refrigerant in the vapor phase is compressed in the compression cylinder. The piston 40 is double acting so that refrigerant material is compressed with movement of the piston in each direction away from a centered position.

The compressed refrigerant material is passed to a condenser 54. In the condenser 54 the refrigerant material condenses to a liquid phase. As the material condenses it gives up heat to a heat sink such as the ambient air or other heat accepting environment.

The liquid refrigerant material in the cooling loop is then passed through an expansion device 56. In the preferred form of the invention the expansion device is an expansion valve which selectively controls the flow of the refrigerant material therethrough. In other embodiments of the invention other types of expansion devices such as fixed orifices or capillary tubes may be used.

The expanded refrigerant material is next passed to an evaporator 58. In the evaporator 58 heat is absorbed by the refrigerant material from the material or area which is to be cooled by the combustion powered cooling system. In the embodiment shown the evaporator 58 absorbs heat from a chilled water circuit 60. In the preferred form of the invention the chilled water circuit is a closed water circuit which is connected to heat exchangers in a building that is cooled by the system. In other embodiments the evaporator may absorb heat from other types of fluids or from other materials.

In the evaporator the refrigerant material in the cooling loop undergoes a change of phase from liquid to vapor. The vaporized refrigerant material is returned to the compressor end of the power unit to repeat the cycle. The cooling loop may include other devices such as an accumulator, filter/dryers and the like. It should be noted however that in the preferred form of the invention the steam piston 26 and compressor piston 40 are magnetically coupled or otherwise non-rigidly connected to the energy transfer mechanism 44. This reduces the risk of possible damage which may occur in other systems which have rigid piston connections. In such conventional systems damage may occur due to undesirable events such as for example, liquid refrigerant material entering the compression cylinder.

Figure 2:
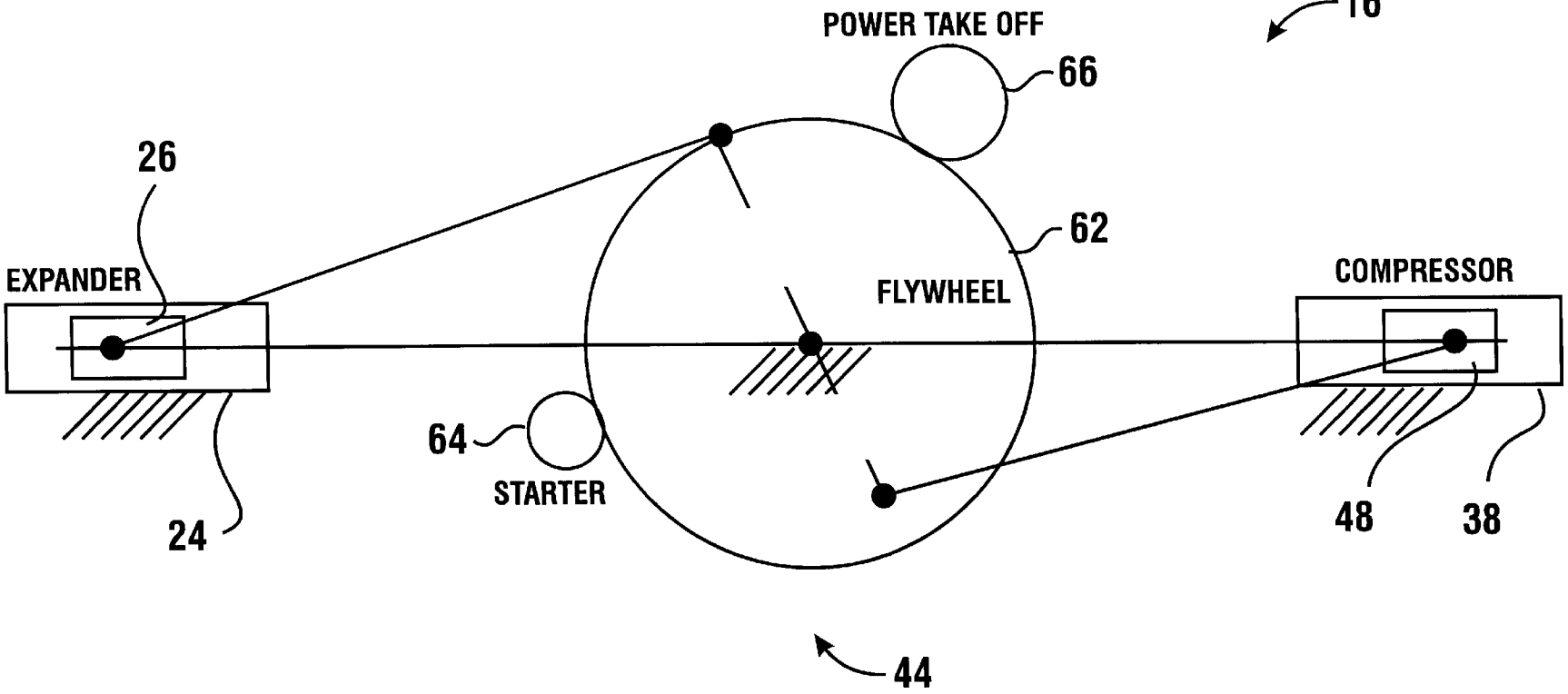
FIG. 2 is a schematic view of the connection in the power unit between the expander and compressor ends.

FIG. 2 shows a schematic view of the power unit 16. In the embodiment shown the steam piston 26 and the compressor piston 48 are connected by an energy transfer device 44. The energy transfer device in the embodiment shown includes a flywheel 62. The flywheel operates to store and transfer energy from the steam piston to the compressor piston. This energy transfer device is preferably used in the embodiment shown to transmit the energy of expansion efficiently. As can be appreciated the expanding steam has liberated much of its energy by the time it reaches the ends of its double acting stroke as the steam piston moves adjacent to the ends of steam cylinder 24. The compressor piston 48 optimally needs energy to compress the refrigerant at the extremes of its stroke at opposed ends of compression cylinder 38. Energy released at the beginning of each stroke of the steam piston is stored in the flywheel so that it is available to compress the refrigerant at the extremes of the stroke of the compressor piston.

It should be noted that in the embodiment shown the steam piston and the compressor piston are operatively connected to the flywheel approximately 180 degrees apart. The size of the flywheel and/or the nature of the energy transfer mechanism may be modified in other embodiments to change the relationship between the phase of the steam expansion stroke and thc compression stroke. Ideally this change would enable the power that is available at the beginning of the expansion stroke of the steam piston to be applied to the compressor piston nearer to the extremes of its compression stroke when greater energy to compress the refrigerant material is desired.

In the embodiment shown the flywheel 62 is operatively connected to a starter motor 64. The starter motor in the preferred embodiment operates to begin rotation of the flywheel to start reciprocating motion of the pistons. Once the flywheel has begun moving, the starter motor no longer supplies energy so that the system operates on steam power.

In the embodiment shown the flywheel 62 is also operatively connected to a power takeoff 66. The power takeoff may be connected to other devices which are connected to the system and which may be conveniently run by mechanical energy available from the flywheel. In one embodiment of the invention the power takeoff may power a generator which produces electrical energy. The electrical energy may be used for operating valves, pumps, control circuitry and other components of the system which are most conveniently run by electrical energy. In some embodiments a battery may be provided which may be charged by the generator driven by the power takeoff 66. This enables the system to be operated in environments where no other source of electricity is available. However, in most systems the amount of electricity required for operation of the system is relatively small.

Figure 3:
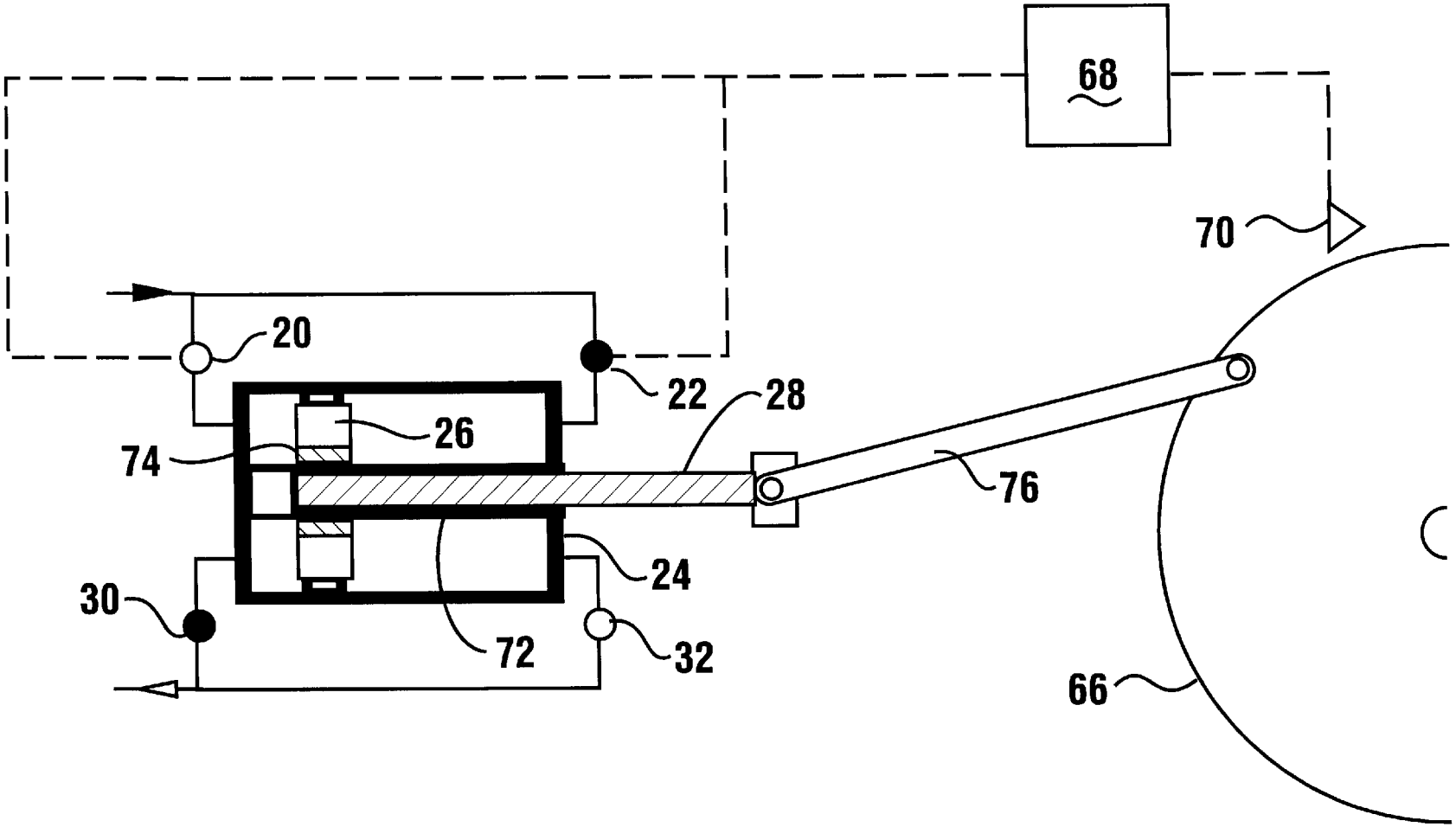
FIG. 3 is a schematic view of a magnetic coupling for the piston in the expander end of the power unit and the control system for the valves which control the flow of steam into the expander end.

As shown in FIG. 3 the power unit includes a control module schematically indicted 68. The control module 68 includes control circuitry and electrical interfaces that operate to control the opening and closing of injection valves 20 and 22 to achieve the reciprocating motion of piston 26 in steam cylinder 24. In a preferred form of the invention, control module 68 operates the injection valves in response to a sensor 70 which operates to sense the relative position of the piston in the steam cylinder. This is done in the embodiment shown by sensor 70 sensing indicators or other indicia that moves in fixed relation with flywheel 66. Because connecting rod 28 is mounted in generally fixed relation to the flywheel 66, sensing of the angular position of the flywheel enables the control module 68 to open and close the injection valves at the appropriate times. In alternative embodiments of the invention, the control module 68 may operate by sensing the position of connecting rod 28 or other components operatively connected with the steam piston.

Control module 68 may operate to control other valves in the system including for example, exhaust valves 30 and 32. Control module 68 may also operate to control other operations such as the flow of gas and air into the steam generator, ignition of the burner in the steam generator, the flow of refrigerant material through the expansion valve 56 and the flow of chilled water through the evaporator 58. This may be done by the control module in response to inputs from appropriate sensors and other input devices.

In the preferred embodiment of the invention connecting rod 28 is operatively connected to steam piston 26 by non-rigid coupling. In one preferred form of the invention magnetic coupling is used to move the connecting rod in response to movement of the piston.

In one preferred form of the invention the steam cylinder 24 is comprised generally of non-magnetic ceramic material. The cylinder 24 includes a central internal cylindrical guide of non-magnetic material which includes a bore 72. Bore 72 is sized to accept connecting rod 28 therein in slidably movable relation. Connecting rod 28 is preferably made of magnetic material.

Steam piston 26 is preferably comprised of non-magnetic ceramic material. Piston 26 has supported thereon an inner annular ring 74 which is magnetic. The inner annular ring 74 is preferably comprised of a material that will tolerate the steam in the power loop which is generally at about 300 psig and 600 degrees Fahrenheit. The magnetic material of the inner annular ring may be comprised of rare earth alloys or ceramic termites, samarian cobalt or neodymion-iron-boron compounds. The magnetic character of the inner annular ring produces a moving magnetic field which acts on the connecting rod 28 and which causes the connecting rod to move in generally coordinated relation with the piston.

In the preferred form of the invention, non-magnetic sealing structures extend between the inner annular ring 74 and an outer wall surface of the guide structure in the cylinder. Likewise, suitable piston rings or other sealing structures extend between the outer circumference of the steam piston and the inner wall of the cylinder. The preferred form of the invention provides an advantage in that the steam piston 26 is enabled to readily move in the steam cylinder without lubrication. The design of the preferred embodiment also provides a closed loop system, as well as a system that is tolerant to imperfect coordination between the steam piston 26 and the connecting rod 28.

As shown in FIG. 3 connecting rod 28 is connected to the flywheel 66 through a first crank shaft 76. The first crank shaft is pivotally mounted to both the connecting rod and the flywheel. In the embodiment of the invention shown the steam cylinder 26 has an inside diameter of approximately 2.5 inches. The steam piston 26 has a double acting total stroke of approximately 7 inches. The piston preferably operates at generally about 720 strokes per minute. The flywheel is generally an 18 inch diameter 50 lb. rim type flywheel in the embodiment shown. The flywheel size may be varied depending on the speed of operation of the system, for example a smaller lighter flywheel may be used at higher operating speeds. In other embodiments other energy transfer mechanisms may be used, of course.

As previously mentioned the compression piston 40 is preferably non-rigidly coupled to connecting rod 42. This is also done in one form of the invention through magnetic coupling techniques. However the cylinder and piston materials and the magnetic materials used in the compressor need not be as exotic as those used in the expander side of the power unit. This is due to the less demanding conditions under which the compressor components must operate. In a preferred form of the invention the compressor cylinder and piston are comprised of nonmagnetic stainless steels. The piston carries a ring of magnetic material which non-rigidly couples through a guide which extends through the compression cylinder, to connecting rod 42 which is comprised of magnetic material. In one preferred form of the invention the compressor has a piston diameter of approximately 1.5 inches and the compressor has a double acting stroke of approximately 2.7 inches. In the embodiment of the system shown, the maximum pressure produced by the compressor is approximately 270 psig.

Figures 4, 5, 6, 7:
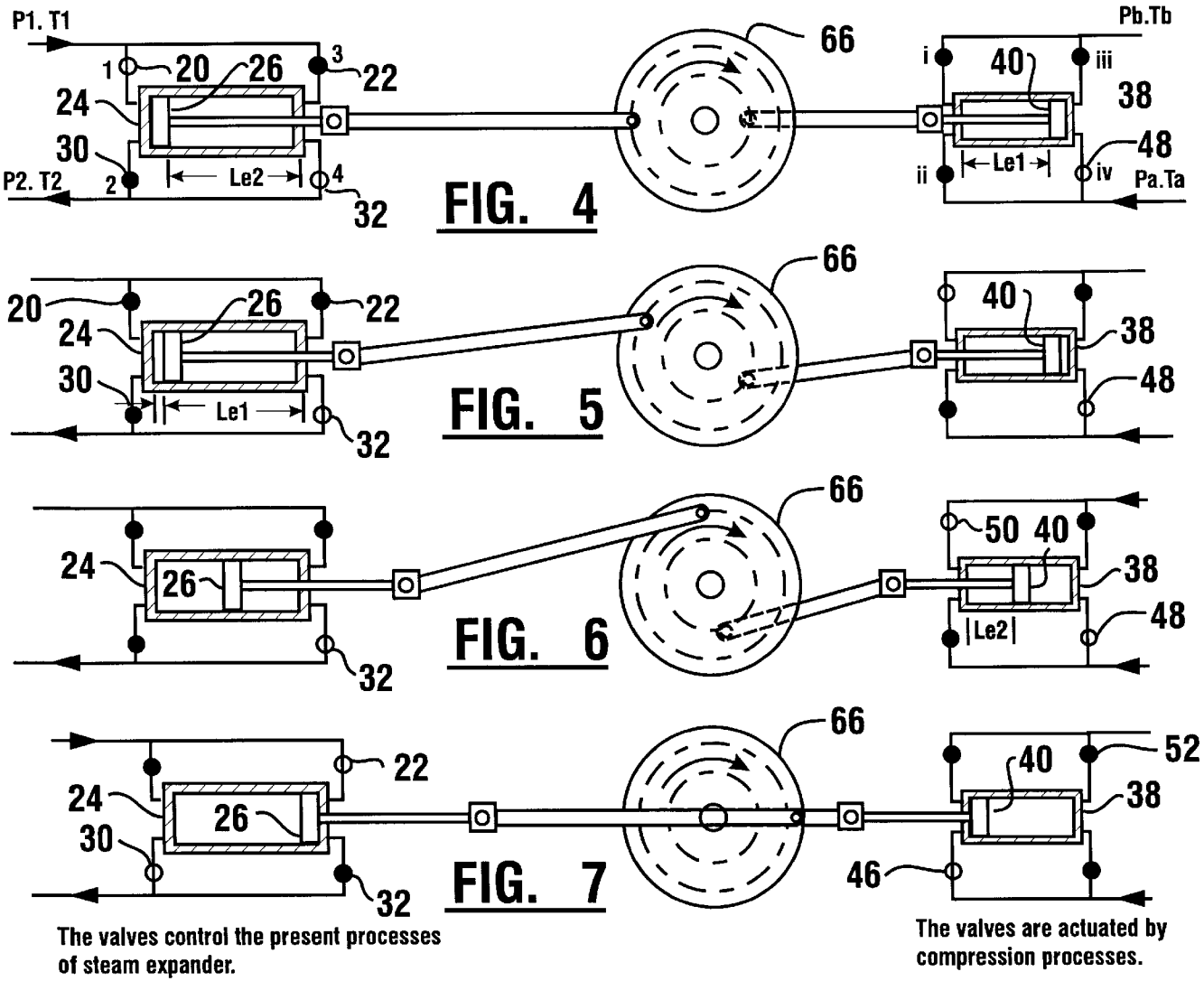
FIGS. 4–7 are schematic views showing the positions of the pistons and valves in the power unit at points in its operating cycle.

The operation of the power unit is now explained with reference to the schematic views shown in FIGS. 4–7. FIG. 4 shows the steam cylinder 24 with the piston adjacent one end. In this position injection valve 20 and exhaust valve 32 are open. Superheated steam enters the left end of the cylinder and expanded steam exhausts from the right end. This moves steam piston 26 to the right as shown. In this position injection valve 22 and exhaust valve 30 are closed.

Movement of steam piston 26 to the right delivers energy to flywheel 66 which rotates in a clockwise direction as shown. Flywheel 66 begins moving compression piston 40 to the left. Inlet check valve 48 opens to allow refrigerant vapor to flow into the right end of compression cylinder 38.

FIG. 5 shows steam piston 26 moved to the right by superheated steam which has entered the left end of cylinder 24. Valve 20 is then closed by the control module 28. Steam piston 26 continues moving to the right as shown as the superheated steam expands. Exhaust valve 32 remains open which enables spent steam to be exhausted from the area to the right of piston 26.

On the compression side of the power unit in FIG. 5 piston 40 is moved further to the left and inlet check valve 48 continues to remain open to enable refrigerant vapor to enter the right side of cylinder 38.

In FIG. 6 on the expander end steam piston 26 is moved further to the right by the expanding superheated steam and exhaust valve 32 remains open allowing spent steam to escape from the right side of the cylinder. On the compressor side piston 40 is moved further to the left. The pressure has increased on the left side of the piston in compression cylinder 38 so that outlet check valve 50 has opened to enable compressed refrigerant vapor to escape from the left side of cylinder 38. Meanwhile vapor continues to enter the right side of cylinder 38 through inlet check valve 48.

In FIG. 7 steam piston 26 has been moved by the expanded steam all the way to the right in steam cylinder 24. The control module 68 now operates to open injection valve 22 to deliver the superheated steam to begin moving piston 26 back towards the left. Exhaust valve 32 closes and exhaust valve 30 opens to enable the now expanded steam which moved steam piston 26 to the right, to escape as the steam piston moves back towards the left.

On the compressor end of the power unit in FIG. 7, compressor piston 40 has moved all the way to the left and now begins moving back towards the right. When this occurs inlet check valve 46 opens to allow refrigerant vapor to enter the left side of the cylinder 38. All the other valves remain closed until the piston has moved sufficiently to the right to force outlet check valve 52 to open.

The reciprocating action continues with the movement of the steam piston at the expander end of the power unit transferring energy through the flywheel in this embodiment, and other energy transfer mechanisms in alternative embodiments, to the piston of the compressor end. This process is continued under the control of the electronic control module for as long, as cooling is required in the chilled water circuit 60 connected to the evaporator 58.

Figure 8:
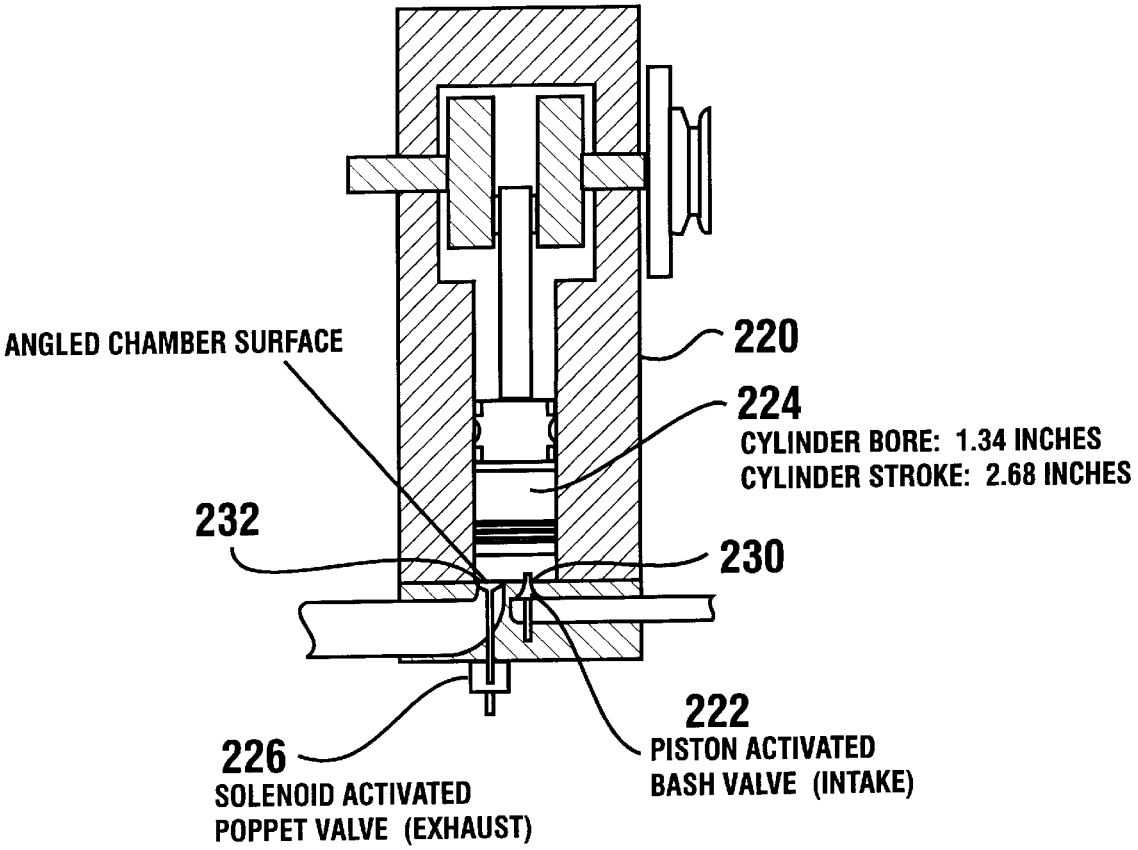
FIG. 8 is a schematic view of the intake and exhaust valves for an embodiment of a steam cylinder.

An alternative embodiment of the expander end of the power unit is shown in FIG. 8. The superheated steam enters the steam expander 220 through the bash valving 222 mechanism. This expander is not like an internal combustion engine in that there need be no compression stroke. The steam enters at full working pressure, moving the piston 224 away from the head 230. The bash valve 222 then closes, allowing the steam to continue expanding until the piston reaches bottom travel. This expansion factor is in the ratio of 35 to 1. In this way all of the energy of the steam is used giving the system a high efficiency, at least 16 to 22%.

When the piston reaches bottom and starts to travel back towards the cylinder head, a solenoid action or direct coupled valve 226 opens to allow the exhaust of the spent steam. This prevents any back pressure from building up as the piston moves toward the head. This will further increase efficiency of the expander. For this embodiment the piston assembly is inverted to ensure that any condensed steam is also pushed out. This allows vapor condensing in the cylinder 232 after the system is shut down to drain through the normally open exhaust valve 226.

Figure 9:
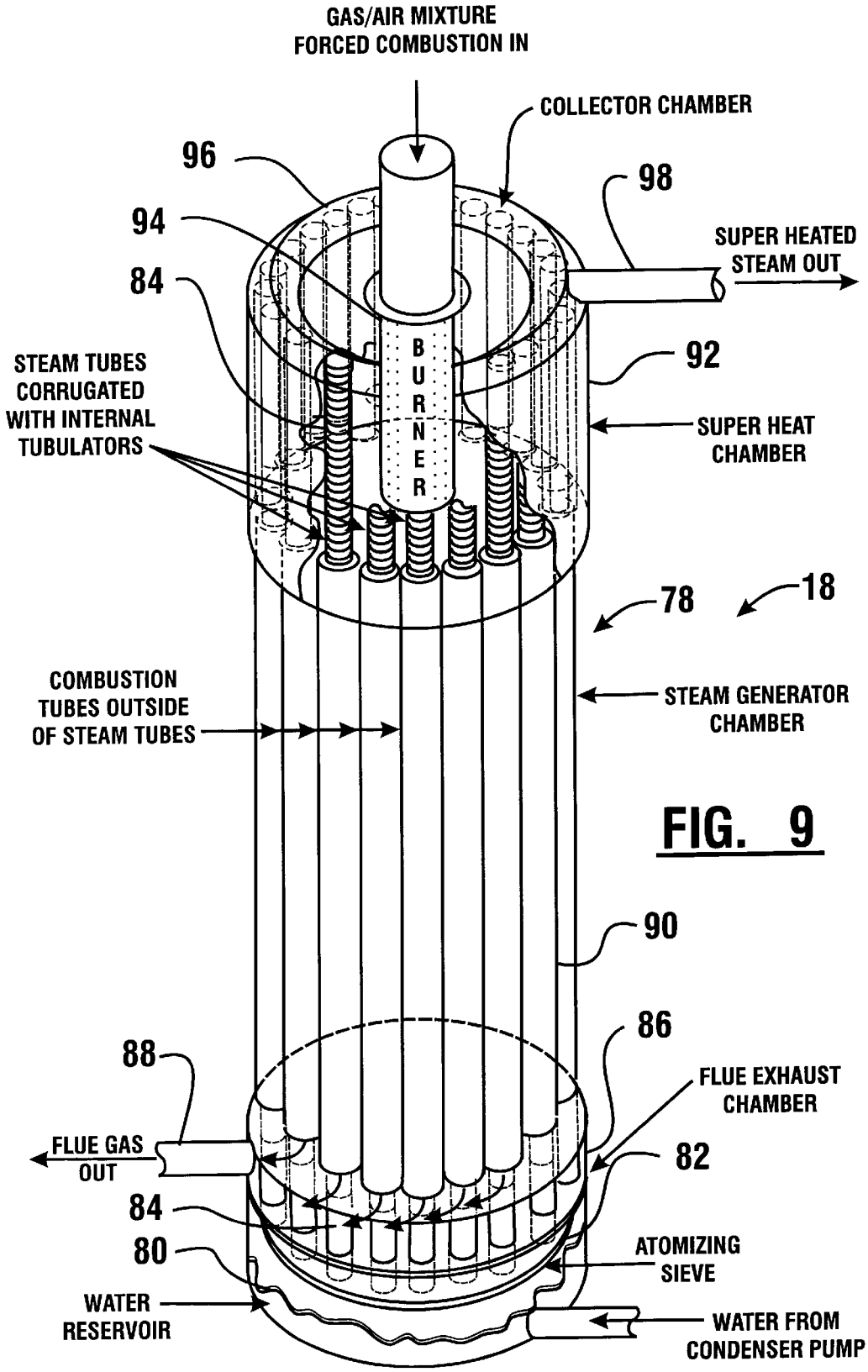
FIG. 9 is a partially sectioned isometric view of the steam generator used in a preferred embodiment of the system.

The construction of the steam generator 18 of the preferred embodiment is explained with reference to FIG. 9. Steam generator 18 includes a body 78. The body has a reservoir area 80 in a lower portion thereof, which receives water in liquid form through a conduit from the condensate pump. Water from the reservoir moves upward through an atomizing sieve 82. As the liquid water passes through the small openings in the atomizing sieve the water is flashed to vapor.

The vapor passes into the interior of a plurality of parallel tubes 84. Tubes 84 are preferably twisted tubes with internal turbulators to facilitate heat transfer. The tubes 84 extend upward through a flue exhaust chamber 86. Combustion products pass out of flue exhaust chamber through an exhaust outlet 88. The products of combustion enter the flue exhaust chamber through outer tubes 90. The outer tubes 90 are in surrounding relation to tubes 84. The combustion products move in a downward direction in the outer tubes 90 which is opposite to movement of the water vapor which moves upward inside the tubes 84.

Tubes 90 extend to a superheat chamber 92. A burner 94 is positioned in centered relation in the superheat chamber. The burner 94 is preferably an inconel mesh type burner which is supplied with a mixture of air and natural gas. The burner produces combustion products at about 1800 degrees Fahrenheit which pass downwards through the outer tubes 90.

The steam carrying tubes 84 pass upward through the superheat chamber 92 to a collector chamber 96. In the superheat chamber, the hot combustion products as well as the radiant energy from the burner, heat the water vapor so as to produce superheated steam. The superheated steam exits from the collector chamber 96 through a steam outlet 98.

In the preferred form of the invention the steam generator body is comprised of stainless steel such as a 316L stainless steel. The vapor tubes 84 are preferably comprised of a cupra/nickel 90/10 material. The entire assembly is preferably covered with Alumina-Silica or other high temperature insulation to minimize heat loss. The insulation preferable has molded strength sufficient to eliminate the need for a metal shroud enclosure which may be susceptible to corrosion. This insulation is also used around the expander components to prevent heat loss. The steam generator preferably operates to produce superheated steam at about 600 degrees Fahrenheit and from about 300 to 100 psig. The embodiment of the invention having the structure described is operative to provide a gas fired air conditioning unit having a 3 ton capacity (600 BTU's per minute). The system is operative to produce this cooling capacity under operating conditions with an outside air temperature of approximately 95 degrees Fahrenheit and with a desired temperature within the area that is air conditioned at 75 degrees Fahrenheit. The system operates with a mass flow rate in the power loop of about 0.407 lbs. per minute of water and a mass flow rate in the cooling loop of about 1.324 lbs. per minute of ammonia. The power unit is operated under these conditions with a flywheel speed of about 720 rpm and the system has a coefficient of performance of approximately 1.051. These performance characteristics are for this embodiment, and other embodiments, may exhibit other properties and performance characteristics.

Figure 10:
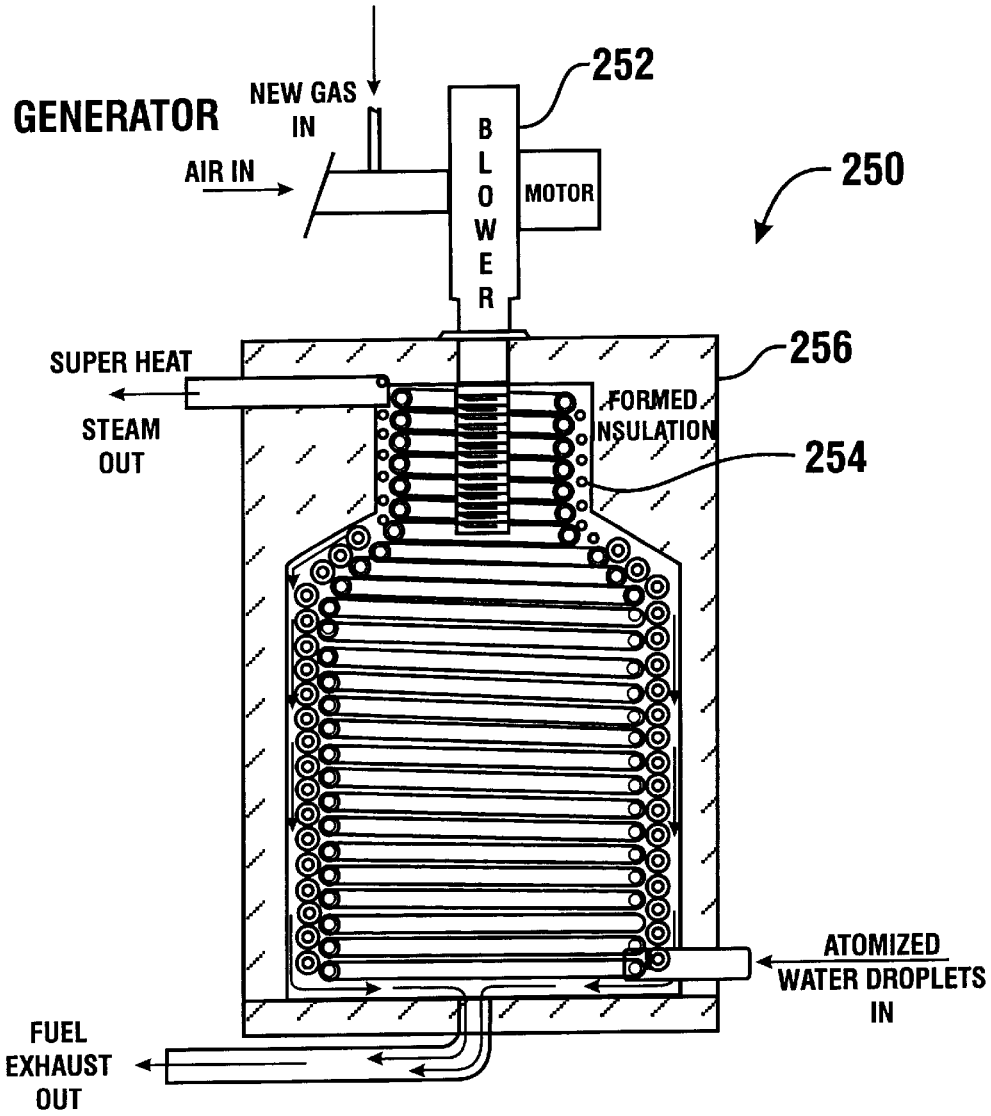
FIG. 10 is a schematic view of an alternate embodiment of the steam generator with a blower for forcing a mixture of air and gas into a burner.

An alternate embodiment of the steam generator is shown in FIG. 10. Here the steam generator 250 includes a blower 252 to provide forced air flow of the combustion air and fine droplet atomization of the natural gas. This provides controlled mixing and combustion of the fuel-air mixture with sufficient excess air to provide a stable operating temperature in the steam generator. The heat generated by the gas combustion is used to superheat a continuous flow of the working fluid. An economizer may be included in the boiler design to preheat the feed fluid. The body of the steam generator 254 is preferably enclosed in formed insulation 256.

The superheated fluid is generated at a rate matched to the flow rate through the expander, obviating the need for higher pressure storage of superheated vapor. In the case of water as the working fluid this embodiment of the steam generator will discharge the superheated steam at about 1000 degrees Fahrenheit and 1000 psia.

Figure 11:
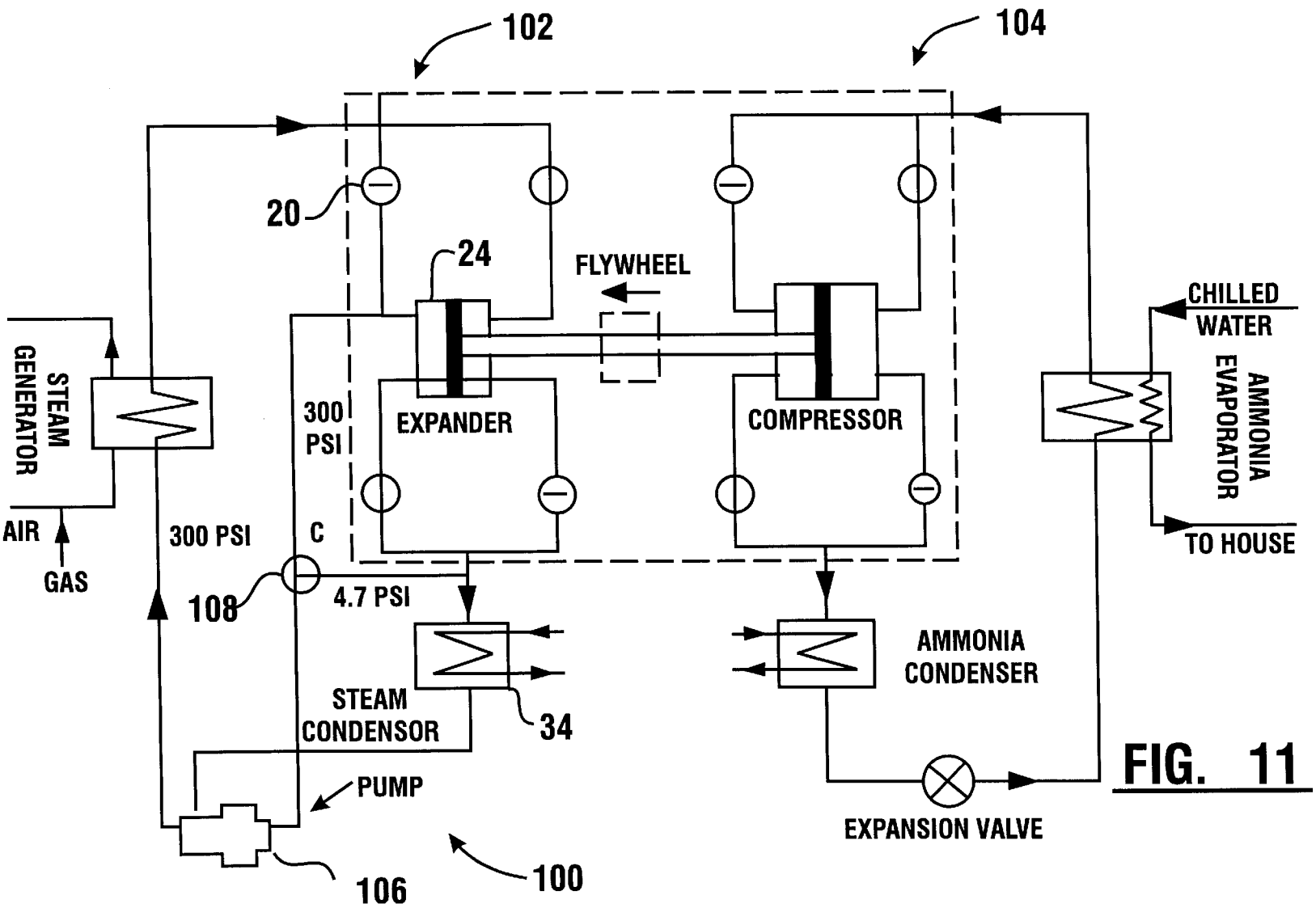
FIG. 11 is a schematic view of an alternative form of the combustion powered cooling system of the present invention.

An alternative embodiment of the combustion powered cooling system generally indicated 100, is shown in FIG. 11. This alternative embodiment includes a power loop 102 and a cooling loop 104. In the embodiment shown cooling loop 104 is identical to cooling loop 14 of the previously described embodiment. Power loop 102 is similar to power loop 12 except that it includes an alternative type of condensate pump which replaces pump 36 of the prior embodiment. All of the other components in power loop 102 are similar to the corresponding components in power loop 12 except as otherwise noted.

Power loop 102 includes an alternative condensate pump 106. Condensate pump 106 is connected to an electronic three way valve 108. Valve 108 operates in response to signals from control module 68 and is operative to alternatively connect a driving mechanism of condensate pump 106 to superheated steam through injection valve 20, or to the expanded steam which enters condenser 34.

Figure 12:
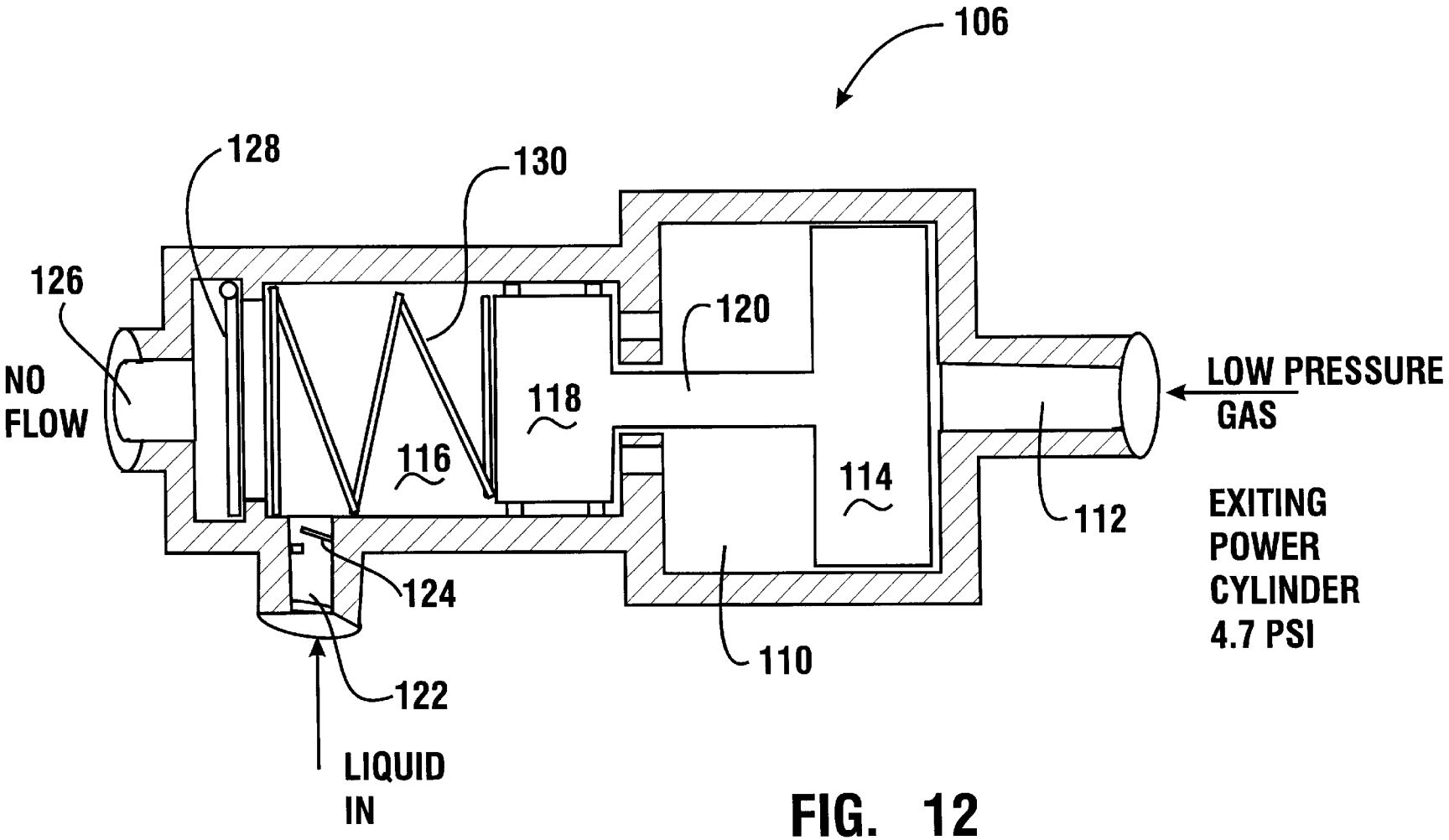
FIG. 12 is a schematic view of a steam powered condensate pump used in the alternative system shown in FIG. 9, the condensate pump being shown in a first position.
Figure 13:
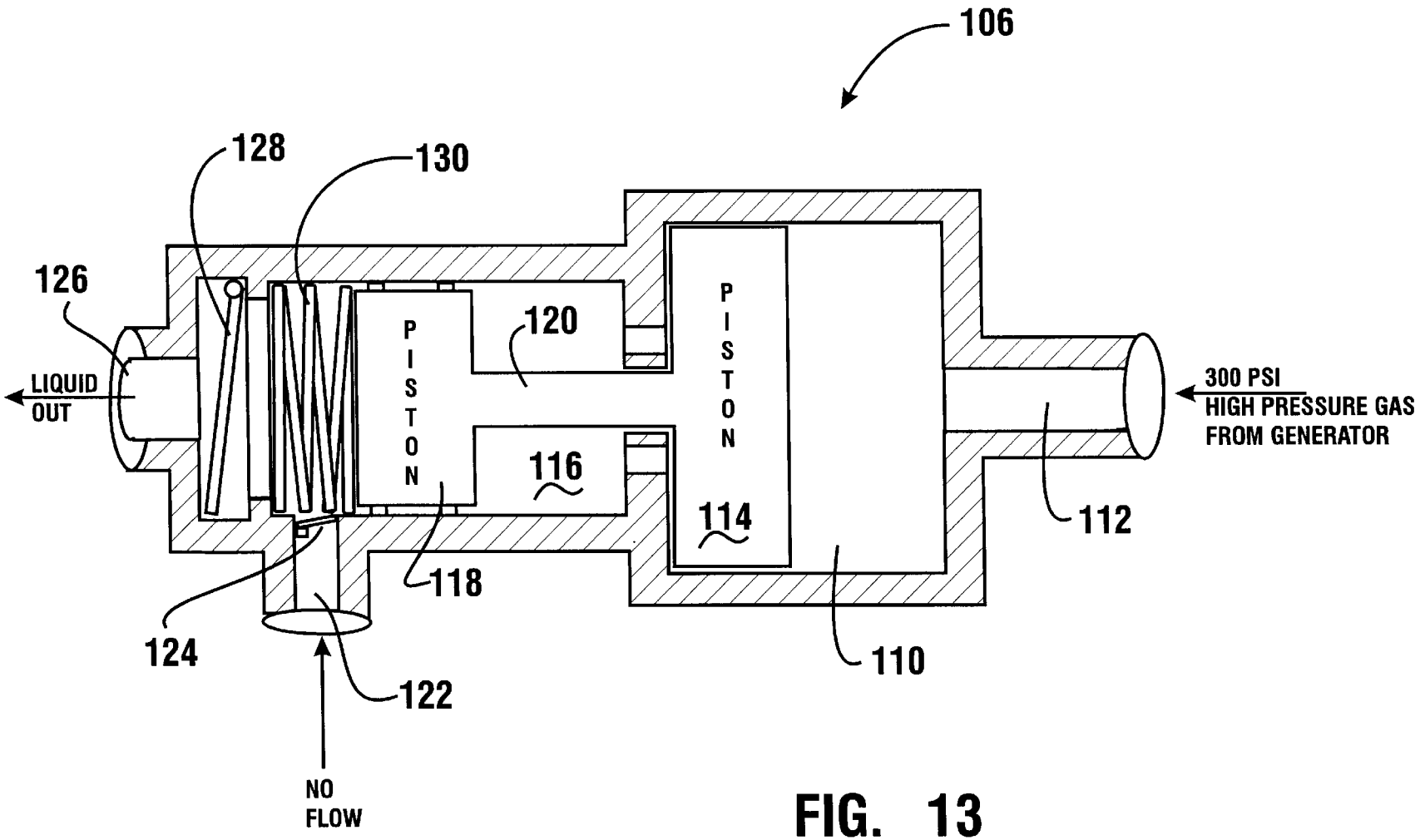
FIG. 13 is a schematic view of the condensate pump shown in FIG. 10 in an alternative position.

Condensate pump 106 is shown in greater detail in FIGS. 12 and 13. Condensate pump includes a body having a first chamber 110 therein. First chamber 110 is connected to a gas inlet 112. Gas inlet 112 is connected to valve 108 which selectively supplies to the gas inlet either 300 psig superheated steam, or expanded steam at approximately 4.7 psig.

The driving mechanism of the condensate pump includes a gas piston 114 which is movable in chamber 110. Condensate pump 106 includes a second chamber 116. A liquid pumping piston 118 is movable in second chamber 116. Liquid pumping piston 118 is connected to gas piston 114 by a connecting rod schematically indicated 120. Connecting rod 120 is journaled in the body of condensate pump 106 so as to enable pistons 114 and 118 to move in back and forth reciprocating motion in their respective chambers.

Second chamber 116 includes a liquid inlet 122. An inlet check valve 124 is positioned in operative connection with inlet 122, and enables flow only into second chamber 116. Second chamber 116 is in connection with a liquid outlet 126. An outlet check valve 128 is positioned adjacent to liquid outlet 126, and enables flow only out of second chamber 116.

A compression spring 130 is mounted in chamber 116. Spring 130 acts on liquid pumping piston 118 and operates to bias piston 118, as well as piston 114 which is connected thereto, to the right as shown in FIGS. 12 and 13. Spring 130 is sized so that when gas inlet 112 is in connection with the relatively low pressure of expanded steam entering condenser 34, the pistons are moved to the position shown in FIG. 12. However when gas inlet 112 is in connection with the superheated steam passing through injection valve 20, the pistons are moved to the left as shown in FIG. 13.

The control module 68 operates to control the opening of valve 108 so that pistons 114 and 118 are moved back and forth in a reciprocating motion. When this occurs liquid from condenser 34 enters chamber 116 through liquid inlet 122 and is pushed out of the condensate pump from liquid outlet 126. Suitable seals are provided between the pistons 114 and 18 and the walls bounding their respective chambers so as to achieve pumping efficiency. The embodiment of the invention shown efficiently uses the energy available from the steam in the power loop to provide the pumping of condensate at the required pressure.

The preferred forms of the present invention provide a high efficiency natural gas powered air conditioning system that can be economically used and operated. In alternative forms of the invention, the system may be combined with other types of components which enable the use of the steam generator to provide heating of a building or other items. For example, the cooling loop may incorporate reversing valving which enables flow in a reverse direction from that shown in the cooling mode, through an expansion device to transfer heat from the atmosphere or other heat sink such as water circuit 60. Of course, other heat transfer techniques may be used. This enables the operator of the system to obtain all their seasonal heating and cooling requirements from the use of natural gas, or other combustion products. This may be particularly helpful in environments where electricity is not readily available.

The systems of the preferred embodiments are also reliable and economical. The systems are further relatively quiet and vibration free. In the embodiment shown which is a three ton air conditioning unit, with the flywheel running at about 720 rpm, the coefficient of fluctuation for the flywheel is only about 0.0069. This is generally comparable to the vibration experienced in the operation of electric motors at comparable speeds and is suitable for residential uses. The system may also be made compact and of a suitable size and weight for residential cooling applications. Alternative embodiments of the system may be used in industrial and other cooling and heat pump applications.

In the heating mode, the system can operate as a normal heat pump, using air source or ground source heat. In addition the system can be used to heat domestic hot water either from a byproduct of the rejected heat from the cooling loop, from the higher efficiency of the heat pump mode, or from the steam generator directly.

Figure 14:
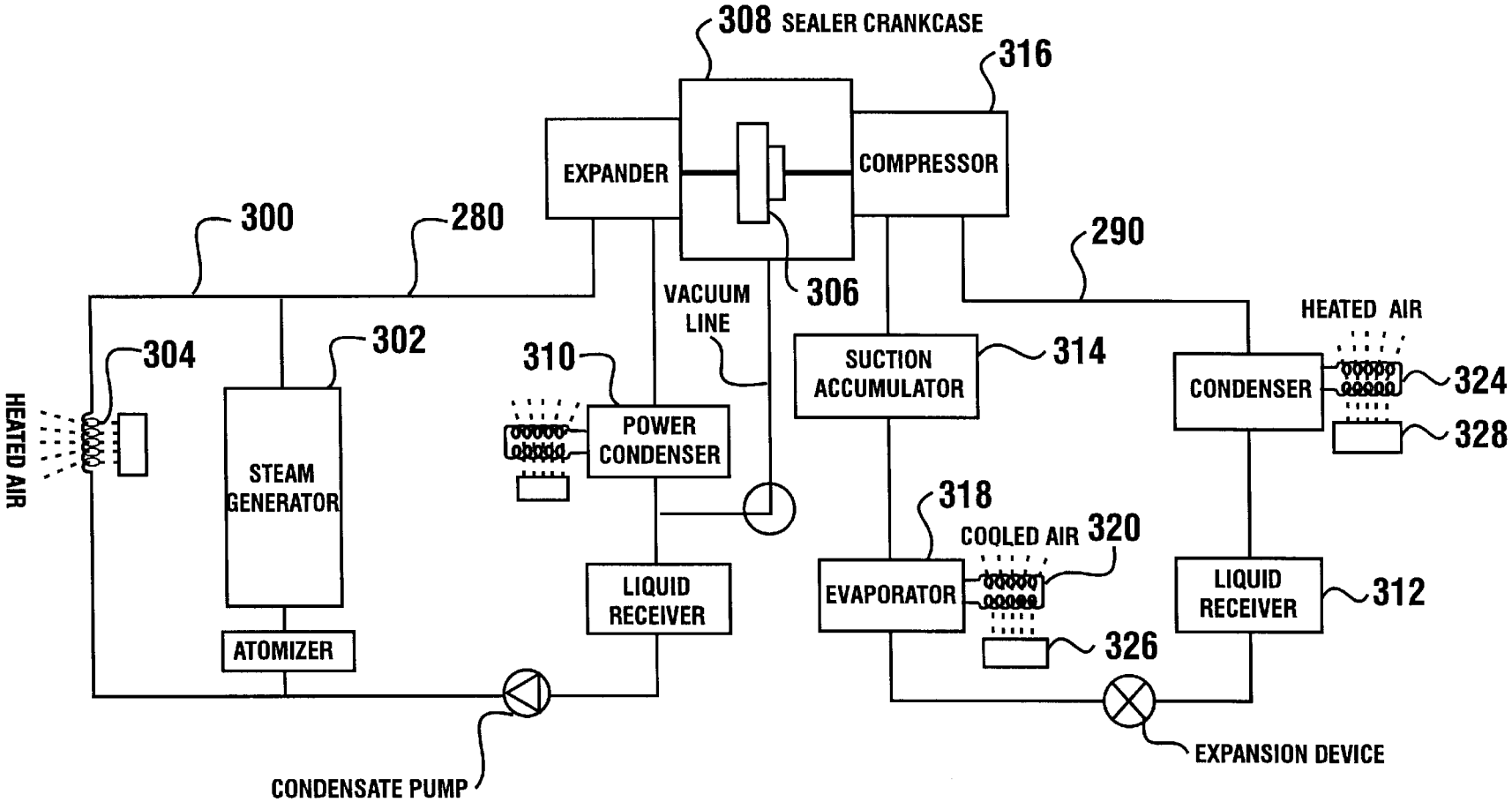
FIG. 14 is a schematic view of an alternative form of the combustion powered cooling system of the present invention.

Another embodiment of the combustion powered cooling system, is shown in FIG. 14. This alternative embodiment includes a power loop 280 and a cooling loop 290. In addition, the system includes a heating loop 300. In extreme low ambient conditions below the optimum use of the heat pump operation, direct steam heat from the steam generator 302 will bypass the expander and go directly to a heating coil 304. Radiant heat from the heating coil is then available for heating a home for example.

In this embodiments, the power transfer elements such as the flywheel 306 are sealed inside a crankcase 308. Because the steam condenser 34 brings the operating pressure in the condenser 310 below atomospheric pressure, the condenser can be used to partial evacuate the crankcase 308. This lower than atomospheric pressure or vacuum in the crankcase increases the efficiency of the power loop.

The cooling loop 290 includes a liquid receiver 312 for storing a supply of the liquid phase of the refrigerant, and a suction accumulator 314 which returns the vapor phase of the refrigerant to the compressor 316. The evaporator 318 includes evaporator coils 320 for extracting heat. A cool air flow can be created by forcing air over the evaporator coils with an air supply. The cooling loop condenser includes condenser coils for releasing heat. From the refrigerant, a warm air flow can be created by forcing air over the condenser coils 224 with an air supply 228.

Figure 15:
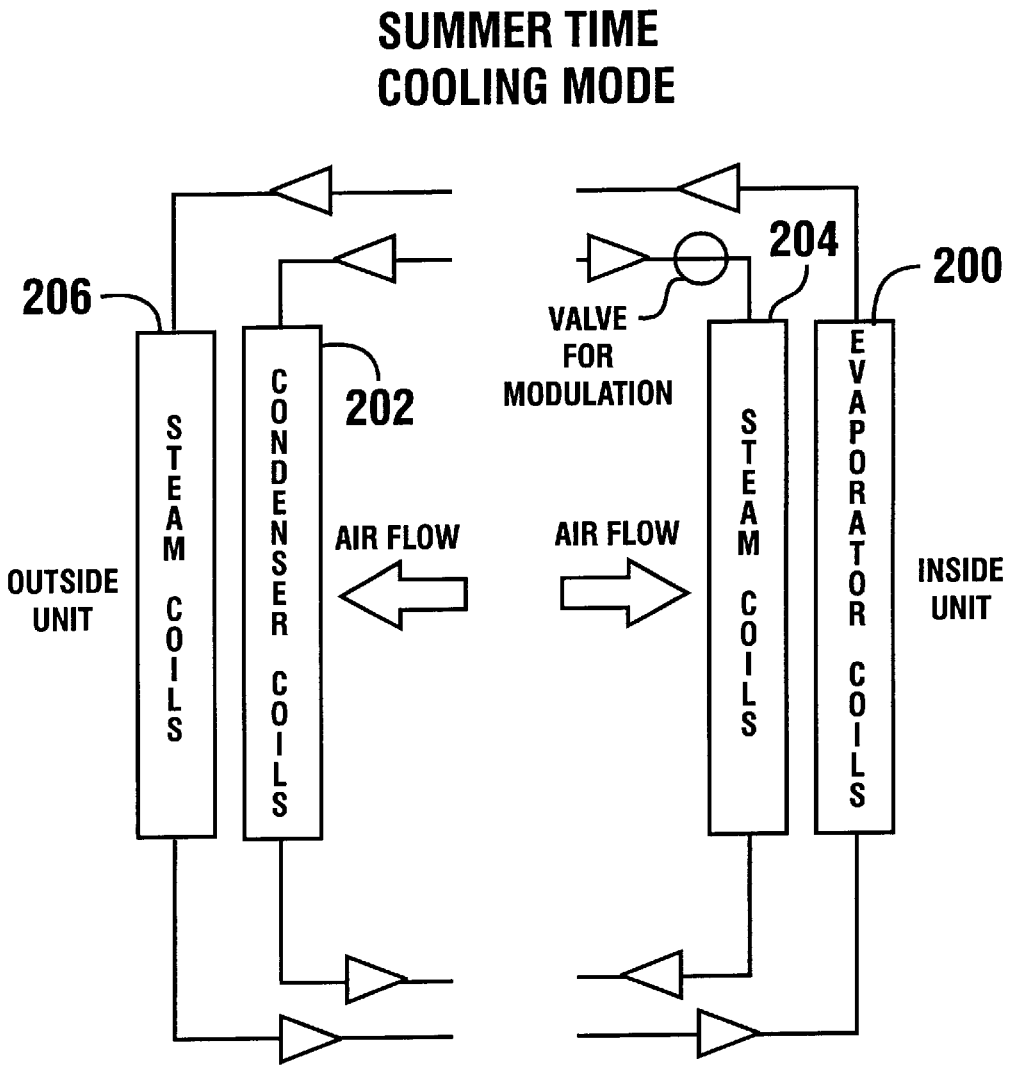
FIG. 15 is a schematic view of an air flow over coils for the power loop and the cooling loop when the system is in a cooling mode.

FIG. 15 schematically represents an exemplary arrangement of cooling loop evaporator coils 200, cooling loop condenser coils 202 and power loop steam coils 204 and 206. In the summer time when the system is in the cooling mode, rejected heat from the power loop steam coils 204 can be used to dry out the air flowing into the system before the air is cooled when passing over the evaporator coils 200. This is modulated so that maximum dehumidification takes place without adding excess heat to the evaporator coils 200. The remaining heat to be rejected from the system is removed by directing an outgoing air flow across cooling loop condenser coils 202 and power loop condenser coils 206.

Figure 16:
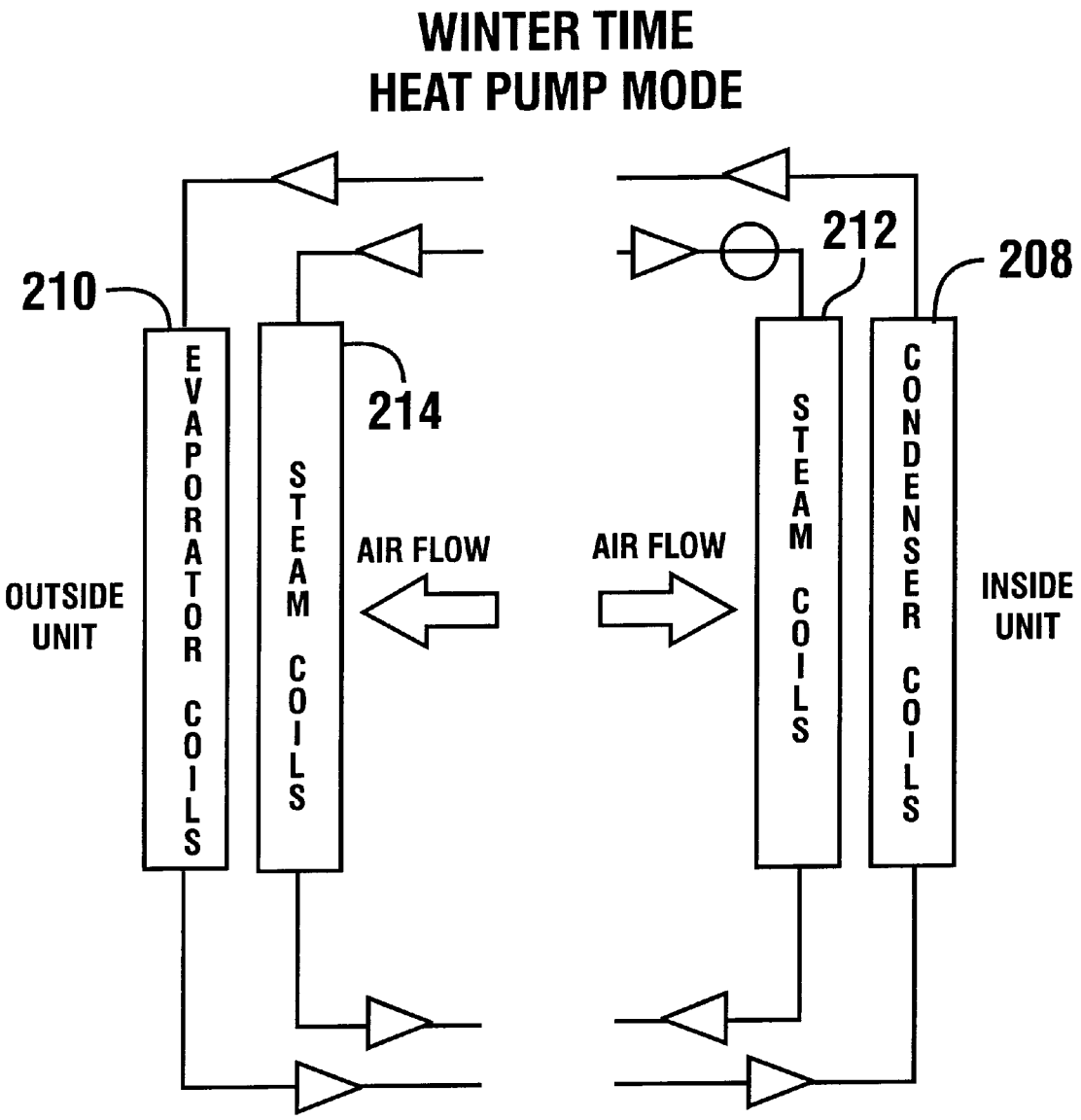
FIG. 16 is a schematic view of an air flow over coils for the power loop and the cooling loop when the system is in a heating mode.

FIG. 16 schematically represents an exemplary arrangement of cooling loop condenser coils 208, cooling loop evaporator coils 210, old power loop steam coils 212 and 214. In the winter time when the system is in the heating mode, the efficient of the system is increased by using rejected heat from the power loop system coils 212 to warm an incoming air flow before the air is further heated by the cooling loop condenser coils 208. To eliminate the need for a defrost cycle, the outgoing air flow is heated by the steam coil 214 before passing over the evaporator coils 210. This flow is also modulated to prevent supper cooling of the steam.

Thus the new combustion powered cooling system of the present invention achieves the above stated objectives, eliminates difficulties encountered in the use of prior devices and systems, solves problems and attains the desirable results described herein.

In the foregoing description, certain terms have been used for brevity, clarity and understanding, however no unnecessary limitations are to be implied therefrom because such terms are used for descriptive purposes and are intended to be broadly construed. Moreover, the descriptions and illustrations given are by way of examples and the invention is not limited to the exact details shown and described.

In the following claims any feature described as a means for performing a function shall be construed as encompassing any means capable of performing the recited function and shall not be deemed limited to the particular means used for performing that function in the foregoing description or mere equivalents thereof.

Having described the features, discoveries and principals of the invention, the manner in which it is constructed, operated and utilized, and the advantages and useful results attained; the new and useful structures, devices, elements, arrangements, parts, combinations, systems, equipment, operations, methods and relationships are set forth in the appended claims.

We claim:

1. a combustion powered cooling system comprising:

a power loop, wherein a first working fluid flows in the power loop;

a cooling loop, wherein a second working fluid flows in the cooling loop;

a power unit in operative connection with the power loop and the cooling loop; wherein the power unit includes an expander end and a compressor end, wherein the expander end includes a steam piston, and wherein the compressor end includes a compressor piston, and wherein the power unit also includes means for transferring power from the steam piston to the compressor piston;

a steam generator in operative connection with the power loop, wherein the steam generator is operative to produce a superheated fluid from the first working fluid, wherein the power loop is operative to selectively deliver the superheated fluid to the steam piston, wherein the steam piston moves in a first reciprocating motion as the superheated fluid is alternately expanded and exhausted from the expander end, wherein the power transfer means is operative to have the compressor piston move in a second reciprocating motion responsive to the first reciprocating motion of the steam piston, and wherein the compressor piston is operative to compress the first working fluid;

a first condenser in operative connection with the power loop, wherein the first condenser is operative to condense the expanded first working fluid to a liquid;

a condensate pump in operative connection with the power loop, wherein the condensate pump is operative to return the liquid first working fluid to the steam generator;

a second condenser in operative connection with the cooling loop, wherein the second condenser is operative to condense the compressed second working fluid to a liquid, wherein heat is released from the compressed second working fluid;

an expansion device in operative connection with the cooling loop, wherein the expansion device is operative to selectively control the flow of the liquid second working fluid therethrough; and an evaporator in operative connection with the cooling loop, wherein the liquid second working fluid passes through the expansion device and expands in the evaporator to a vapor phase; and wherein the second working fluid acquires heat when expanding to a vapor phase; and wherein the vapor second working fluid returns to the compressor end.

2. The combustion powered cooling system as recited in claim 1, wherein the first working fluid is water and wherein the second working fluid is a ammonia.

3. The combustion powered cooling system as recited in claim 1, wherein the evaporator includes evaporator coils, wherein the second condenser includes condenser coils, wherein the system is operative to have a first air flow pass across the evaporator coils, wherein the evaporator coils remove heat from the first air flow, wherein the system is operative to have a second air flow pass across the condenser coils, wherein the second air flow acquires heat from the second condenser.

4. The combustion powered cooling system as recited in claim I wherein the system further includes a heating loop, wherein the heating loop comprises the super heated fluid from the steam generator, wherein the system is operative to have an air flow across a portion of the heating loop, wherein the air flow acquires heat from the heating loop.

5. The combustion powered cooling system as recited in claim 1, wherein the power unit further comprises a starter mechanism for starting the reciprocating motion of the steam piston.

6. The combustion powered cooling system as recited in claim 1, wherein the cooling loop includes a liquid receiver tank between the second condenser and the expansive device, wherein the liquid receiver is operative to store a supply of the second working fluid before the second working fluid is expanded.

7. The combustion powered cooling system as recited in claim 1, wherein the expander end includes a steam cylinder and the compressor end includes a compressor cylinder, wherein the steam piston is movably mounted in the steam cylinder, and wherein the compressor piston is movably mounted in the compressor cylinder.

8. The combustion powered cooling system as recited in claim 7, wherein the power unit includes a plurality of cylinder valves for selectively delivering and removing the first working fluid in the steam cylinder and the second working fluid in the compressor cylinder.

9. The combustion powered cooling system as recited in claim 7, wherein the steam cylinder includes two opposed steam cylinder ends, wherein the first steam cylinder end includes a first injection valve and a first exhaust valve, wherein the second steam cylinder end includes a second injection valve and a second exhaust valve, wherein the first and second injection valves are operative to alternatively deliver the superheated fluid into the first and the second steam cylinder ends, wherein when superheated fluid is delivered to the first steam cylinder end the superheated fluid expands and moves the steam piston towards the second steam cylinder end wherein the second exhaust valve is operative to exhaust expanded first working fluid from the second steam cylinder end, wherein when superheated fluid is delivered to the second steam cylinder end the superheated fluid expands and moves the steam piston towards the first steam cylinder end, wherein the first exhaust valve is operative to exhaust expanded first working fluid from the first steam cylinder end.

10. The combustion powered cooling system as recited in claim 9, wherein the first and second injection valves each include a movable metal diaphragm.

11. The combustion powered cooling system as recited in claim 9, wherein the first and second injection valves comprise bash valves.

12. The combustion powered cooling system as recited in claim 1, wherein the means for transferring power from the steam piston to the compressor piston comprises a rotating flywheel, wherein a first rod is in operative connection between the steam piston and the flywheel, wherein as the steam piston reciprocates the first rod is operative to impart the flywheel with rotational energy.

13. The combustion powered cooling system as recited in claim 12, wherein the connection between the steam piston and the first rod includes a magnetic coupling.

14. The combustion powered cooling system as recited in claim 13, wherein the steam cylinder is comprised of non-magnetic ceramic material, wherein the steam cylinder includes a central internal cylindrical non-magnetic guide, wherein the cylindrical guild includes a bore that is operative to accept the first rod therein in slidably movable relation, wherein the first rod comprises a magnetic material, wherein the steam piston includes a magnetic inner annular ring, and wherein as the steam piston moves along the cylindrical guide, the first rod is operative to move along the bore responsive to the magnetic pull of the annular ring of the steam piston.

15. The combustion powered cooling system as recited in claim 12, wherein a second rod is in operative connection between the compressor piston and the flywheel, wherein as the flywheel rotates the second rod is operative to have the compressor piston reciprocate.

16. The combustion powered cooling system as recited in claim 15, wherein the connection between the compressor piston and the second rod includes a magnetic coupling.

17. The combustion powered cooling system as recited in claim 7, wherein the means for transferring power resides inside a sealed crankcase, wherein the crankcase is not in fluid communication with the steam cylinder or the compressor cylinder, wherein the crankcase is in operative connection with the first condenser, wherein the first condenser has a pressure that is below atmospheric pressure, wherein the condenser is operative to partially evacuate the crankcase.

18. The combustion powered cooling system as recited in claim 7 wherein the compression cylinder includes two opposed cylinder ends, wherein the first compression cylinder end includes a first inlet check valve and the second compression cylinder end includes a second inlet check valve, wherein the first and second inlet check valves are operative to alternatively deliver the second working fluid in the vapor phase into the first and the second compression cylinder ends, wherein the compressor piston reciprocates between the first and the second compression cylinder ends, wherein the compressor piston is operative to alternatively compress the second working fluid at each of the compression cylinder ends.

19. The combustion powered cooling system as recited in claim 18, wherein the first compression cylinder end includes a first outlet check valve and the second compression cylinder end includes a second outlet check valve, wherein the first and second outlet check valves are operative to alternatively release the compressed second fluid from the first and second compression cylinder ends.

20. The combustion powered cooling system as recited in claim 8, further comprising a control module, wherein the control module is operative to selectively control the cylinder valves, wherein the power unit further includes a sensor, wherein the sensor is operative to output a plurality of data values representative of the relative locations of the steam piston inside the steam cylinder and the cylinder piston inside the compression cylinder, wherein the control module is operative to control the cylinder valves responsive to the data values.

21. The combustion powered cooling system as recited in claim 1, wherein the steam generator includes a burner and a blower, wherein the blower is operative to force a mixture of air and a gas into the burner, wherein the burner is operative to burn the mixture; wherein the heat released by the combustion of the mixture converts the first working fluid into a superheated fluid.

22. The combustion powered cooling system as recited in claim 21, wherein the burner includes an inconel mesh.

23. The combustion powered cooling system as recited in claim 21, wherein the steam generator includes a reservoir of the first working fluid in the liquid phase and an atomizing sieve, wherein the atomizing sieve includes a plurality of small openings, wherein as the first working fluid passes through the small openings the first working fluid is flashed to a vapor phase.

24. The combustion powered cooling system as recited in claim 23, wherein the steam generator further includes a superheated chamber, wherein the superheated chamber includes the burner, wherein the combustion of the mixture produces radiant energy for converting the vapor first working fluid into a superheated fluid.

25. The combustion powered cooling system as recited in claim 1, wherein the steam generator is covered with a high temperature insulation.

26. The combustion powered cooling system as recited in claim 1, further comprising a 3 way valve, wherein the condensate pump includes a biased pumping piston, wherein the three way valve is operative is alternatively supply the condensate pump with superheated fluid or expanded first working fluid, wherein the periodic supply of high pressure superheated fluid and low pressure expanded first working fluid is operative to have the biased pumping piston reciprocate, wherein the reciprocating motion of the biased pumping piston is operative to pump a supply of liquid first working fluid from the first condenser to the steam generator.

27. The combustion powered cooling system as recited in claim 8, wherein the power unit further includes an electric generator, wherein the electric generator is powered by the mechanical energy of the power unit, wherein at least one of the cylinder valves is electrically operated, wherein the electric generator provides electricity for operating the electric cylinder valve.

28. The combustion powered cooling system as recited in claim 1, wherein the evaporator includes a chilled water circuit, and wherein the second working fluid in the evaporator removes heat from the chilled water circuit.

29. The combustion powered cooling system as recited in claim 1 further comprising an air flow into the system and a set of steam coils, wherein the set of steam coils is in operative connection with the power loop, wherein the evaporator includes a set of evaporator coils, wherein the evaporator removes heat from the evaporator coils, wherein when the system is in a cooling mode, the steam coils heat the air flow to reduce the humidity level of the air flow before the airflow passes across the evaporator coils, wherein the evaporator coils cool the air flow by removing heat from the airflow.

30. The combustion powered cooling system as recited in claim I further comprising an air flow out of the system and a set of steam coils, wherein the set of steam coils is in operative connection with the power loop, wherein the evaporator includes a set of evaporator coils wherein when the system is in a heating mode, the steam coils heat the air flow before the airflow passes across the evaporator coils, wherein the evaporator coils are defrosted by the heated airflow.

31. The combustion powered cooling system as recited in claim 1 further comprising an air flow into the system and a set of steam coils, wherein the set of steam coils is in operative connection with the power loop, wherein the second condenser includes a plurality of condenser coils, wherein when the system is in a heating mode, the steam coils heat the air flow before the airflow passes across the condenser coils, wherein the condenser coils further heat the air flow.

32. The combustion powered cooling system as recited in claim 1 further comprising an air flow out of the system and a set of steam coils, wherein the set of steam coils is in operative connection with the power loop, wherein the second condenser includes a plurality of condenser coils, wherein when the system is in a cooling mode, the air flow removes heat from the condenser coils before passing across the steam coils, wherein the air flow further removes heat from the steam coils.

33. A method for cooling comprising the steps of:

a) burning a mixture of gas and air inside a steam generator to generate heat energy;

b) flashing a first working fluid from a liquid phase to a vapor phase with the heat from the steam generator;

c) superheating the vapor first working fluid to a superheated fluid with heat from the steam generator;

d) generating mechanical power by moving a steam piston in a reciprocating motion inside a steam cylinder of an expander by injecting superheated fluid and exhausting expanded first working fluid from the steam cylinder;

e) condensing the expanded first working fluid to a liquid phase with a first condenser;

f) pumping the liquid first working fluid to the steam generator;

g) transferring mechanical power from the expander to a compressor piston inside a compression cylinder of a compressor, wherein the compressor piston has a reciprocating motion;

h) compressing a second working fluid with the compressor piston;

i) condensing the compressed second working fluid from a vapor phase to a liquid phase in a second condenser wherein heat is released from the second working fluid;

j) controlling the flow of liquid second working fluid to an evaporator with an expansion device;

k) expanding the second working fluid from a liquid to a vapor in the expander; wherein the expander includes expander coils, wherein the second working fluid acquires heat from the expander coils;

l) removing heat from an air flow passing across the expander coils; and m) returning the vapor second working fluid to the compressor.

* * * * *

UNITED STATES PATENT AND TRADEMARK OFFICE

CERTIFICATE OF CORRECTION

PATENT NO. : 6,138,457
DATED : October 31, 2000
INVENTOR(S) : Lackstrom, et al.

It is certified that error appears in the above-identified patent and that said Letters Patent is hereby corrected as shown below:

Title page,
-- Related U.S. Application Data Provisional Application No. 60/076,341, Feb. 27, 1998. --

Column 1,
Line 2, add -- This application claims benefit of provisional application no. 60/076,341, Feb. 27,1998. --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*